United States Patent [19]

Bewer et al.

[11] 4,252,629

[45] Feb. 24, 1981

[54] ELECTRODE FOR ELECTROCHEMICAL PROCESSES ESPECIALLY ELECTROWINNING AND METHOD FOR MANUFACTURING SAME

[75] Inventors: Günter Bewer, Westendorf; Hans Herbst; Dieter Lieberoth, both of Meitingen, all of Fed. Rep. of Germany

[73] Assignee: Sigri Elektrographit GmbH, Meitingen bei Augsburg, Fed. Rep. of Germany

[21] Appl. No.: 26,523

[22] Filed: Apr. 3, 1979

[30] Foreign Application Priority Data

Nov. 26, 1977 [DE] Fed. Rep. of Germany ..... 2752875

[51] Int. Cl.[3] ..... C25B 11/10; C25B 11/16

[52] U.S. Cl. ..... 204/290 F; 204/38 B; 204/291

[58] Field of Search ..... 204/290 K, 291, 290 F

[56] References Cited

U.S. PATENT DOCUMENTS

| | | | |
|---|---|---|---|
| 2,631,115 | 3/1953 | Fox | 204/290 K |
| 3,855,084 | 12/1974 | Feige | 204/38 R |
| 4,029,566 | 6/1977 | Brandmair et al. | 204/290 F |

FOREIGN PATENT DOCUMENTS

| | | | |
|---|---|---|---|
| 83339 | 7/1970 | German Democratic Rep. | 204/290 K |

*Primary Examiner*—F. Edmundson
*Attorney, Agent, or Firm*—Herbert L. Lerner

[57] ABSTRACT

Sintered electrode especially for use in electrowinning formed of a corrosion-resistant carrier consisting at least in part of sintered $TiO_x$, wherein $x=0.25$ to 1.5, and a coating of manganese dioxide covering at least part of the surface of the carrier.

6 Claims, No Drawings

ELECTRODE FOR ELECTROCHEMICAL PROCESSES ESPECIALLY ELECTROWINNING AND METHOD FOR MANUFACTURING SAME

BACKGROUND OF THE INVENTION

1. Field of the Invention

This invention relates to a sintered electrode for electrochemical processes, especially for the electrochemical winning of metals, which is corrosion-resistant under electrolysis conditions, as well as a method for manufacturing the electrode.

2. Description of the Prior Art

Because of the strong corrosive attack under the conditions of the electrolysis, only few materials such as graphite, lead, nickel and platinum are suitable as electrodes, especially the anode, in processes for the electrochemical winning of metals. From the German Published Non-Prosecuted Applications 1 796 220 and 26 36 447, electrodes for this purpose are known which consist of a carrier or a base of titanium and a coating which covers the surface of the carrier and contains to a substantial extent manganese dioxide. Since the surface of the carrier of such electrodes is passivated under the electrolysis conditions in spite of the activation coating and the cell voltage rises in the process for constant current density, the electrodes can generally be operated only with rather low current densities. It is known to delay the passivation of the electrode carrier by a special coating consisting of several layers. According to German Published Non-Prosecuted Application 26 57 97 9, the covering layer applied to the carrier consisting of a metal that can be passivated, is composed of a coating layer consisting of an intermediate layer which contains oxides of tim and antimony, and of a cover layer which consists substantially of manganese dioxide. An anode is known from the French Provisional Patent No. 2 236 027, which on a sintered carrier of metallic titanium has a first manganese dioxide layer formed by thermal decomposition of a manganese compound, and a second manganese dioxide layer which is deposited electrochemically.

The preparation of coatings consisting of several individual layers is relatively expensive and, in addition, passivation of the carrier can be prevented only if the diffusion of oxygen ions through the layers is completely inhibited or is, at least, very small.

SUMMARY OF THE INVENTION

It is now an object of the invention to provide an electrode, and particularly, an anode with a coating of manganese dioxide, the voltage drop of which does not increase, or only insignificantly so, over extended periods of operation and which can be made simply.

With the foregoing and other objects in view, there is provided in accordance with the invention a sintered electrode for electro-chemical processes especially for electrowinning which comprises a corrosion-resistant carrier consisting at least in part of sintered titanium oxide $TiO_x$, wherein x=0.25 to 1.5, and a coating of manganese dioxide covering at least in part the surface of the carrier.

In accordance with the invention there is provided a corrosion-resistant electrode for electrolysis of metal contained in aqueous solutions comprising an electrode base consisting at least partially of titanium oxide $TiO_x$, wherein x=0.25 to 1.5, formed by moulding titanium oxide powder and sintering the moulded shape by heating in an inert gas atmosphere to a temperature of from 900° to 1400° C., and a covering layer of manganese dioxide.

There is provided in accordance with the invention a method for manufacturing a sintered electrode for electrochemical processes especially electrowinning which comprises coating a slab-shaped carrier body of sintered titanium with titanium oxide $TiO_x$, wherein x=0.25 to 1.5, joining the layer of titanium oxide $TiO_x$ to the slab-shaped carrier body of sintered titanium by heating in an inert atmosphere to a temperature of 900° to 1400° C., and covering at least in part the resultant titanium oxide-titanium body with a coating of manganese dioxide.

Other features which are considered as characteristic for the invention are set forth in the appended claims.

Although the invention is illustrated and described herein as embodied in an electrode for electrochemical processes especially electrowinning, and method for manufacturing same, it is nevertheless not intended to be limited to the details shown, since various modifications may be made therein without departing from the spirit of the invention and within the scope and range of equivalents of the claims.

DETAILED DESCRIPTION OF THE INVENTION

The invention is based on the surprising discovery that the operability, and in particular the magnitude of the critical current density and the constancy in time of the electrode potential of anodes comprising coatings of manganese dioxide are to a substantial degree determined by the material composition of the carrier. Carriers consisting of metallic titanium form under anodic load a thin surface layer of titanium dioxide, the thickness of which is hardly changed as long as a critical current density is not exceeded. Under these conditions, the electric charges are transported exclusively by electrons. However, if the current density is increased beyond the critical limit, then oxygen ions diffuse from the manganese-dioxide-containing coating layer into the carrier metal.

$$\frac{2}{x}\,MnO_2 + Ti \longrightarrow \frac{2}{x}\,MnO_2 - x + TiO_2 \quad (0 < x << 1)$$

The increasing thickness of the $TiO_2$-layer rapidly leads to complete inactivation of the anode.

Titanium oxides $TiO_x$, with x=0.25 to 1.50, exhibit the same corrosion resistance as metallic titanium. The passivation behavior, however, is substantially different. If, for instance, an electrode of titanium is used as the anode, the current drops even with higher voltages to zero within a few seconds. However, the current decreases only slowly under the same conditions if an anode is used which is provided with a $TiO_x$ layer or consists completely of $TiO_x$, and the activity of the anode changes only after an extended time of operation to any appreciable degree. The effect can perhaps be explained by the greater mobility of the oxygen ions in the crystallographically disturbed lattice of the $TiO_x$-phases and the high electron conductivity of the suboxide, which inhibits the formation of a $TiO_2$ barrier layer on the surface of the titanium carrier.

Titanium members made by powder metallurgy are particularly well suited as carrier for an electrode according to the invention. The irregular surface shape of the titanium member makes a particularly advantageous adhesion base for a layer of titanium oxide $TiO_x$ which is applied to the surface of the carrier in known manner with a spatula, by brushing or pressing, or by flame or plasma spraying, and is then sintered-on at an elevated temperature. The thickness of the $TiO_x$ layer is at least 0.1 mm and in particular 0.1 to 5 mm. According to a further embodiment of the invention, the carrier consists entirely of a titanium oxide $TiO_x$.

for preparing the compounds $TiO_x$, titanium metal and titanium dioxide powder are mixed in a ratio of 7:1 to 1:3, optionally after addition of a binder such as an aqueous solution of polyvinyl alcohol. The mixture is pressed into sheet or briquettes and the pressed blanks are sintered in an inert atmopshere in the temperature range between 900° and 1500° C. By the temperature treatment of the densified Ti-$TiO_2$ powder mixture, substantially uniform $TiO_x$-phases are formed which correspond to the respective stoichiometric composition, and with a considerably disturbed lattice. Thus, one has, for instance, in the range $x=0.6$ to 1.25, a compound of the NaCl type with incompletely occupied lattice locations; in the range $x<0.42$, the $\alpha$-titanium lattice is expanded by embedded oxygen, and in the ranges $x=0.42$ to 0.60 and $x=1.25$ to 1.50, the reaction product consists of mixtures of the disturbed $\alpha$-titanium and TiO-phases or the TiO and $TiO_2$-phases. The blanks are comminuted and milled to make a fine powder, the grain size of which is about 10 to 75 $\mu$m. In this form, it is fed, for instance, to a plasma burner and applied in an argon atmosphere to the base part, made of sintered titanium, of the carrier. According to another preferred method, a binder such as polyvinyl alcohol or methyl cellulose is added to the powder, which is applied to a sintered titanium member by painting, brushing or spraying and is sintered to the member by heating. In another method, a layer of titanium powder is overlaid with a layer of $TiO_x$ powder and the layers are then pressed into a carrier of the desired dimensions and subsequently sintered. The development and stoichiometric composition of the $TiO_x$-portion of the carrier are determined particularly also by the sintering conditions. The sintering is accomplished in an inert atmosphere, for instance, in argon or in a vacuum. The sintering temperatures are preferably 900° to 1400° C. In the temperature range up to about 1250° C., the required sintering time is inversely proportional to the temperature. Above about 1250° C., the mobility of the oxygen increases considerably, so that a larger share of oxygen diffuses from the $TiO_x$-layer into the titanium layer of the carrier. This effect, which is advantageous for a firm anchoring of the two carrier layers, can be controlled by limiting the sintering time in such a manner that the overall formula $TiO_x$ of the intermediate layer is within the limits $x=0.25$ and $x=1.50$. However, the actual composition varies, depending on the sintering conditions, over the thickness of this layer, the oxygen content declining from the surface toward the boundary layer. $TiO_x$-layers with an oxygen content above 1.50 have an electric resistance which is not suitable for electrodes, and processing is made difficult, in addition, because of the brittleness of the material. Layers with an oxygen content below 0.25 cannot sufficiently prevent, under unfavorable conditions, the formation of passivation layers. $TiO_x$-layers with the composition $TiO_x$ with $x=0.42$ to 0.60 have particularly advantageous properties.

All known coating methods are equally well suited for coating the electrode carrier with a coating of manganese dioxide. For instance, the carrier can be impregnated with an aqueous solution of a manganese salt such as manganese nitrate, and the salt can be decomposed by heating it to about 300° C., whereby the oxide is obtained in the $\beta$-form. According to another method, manganese dioxide is applied electrolytically from a manganese sulfate-containing solution to the surface of the carrier. The layer of manganese dioxide forming part of the electrode according to the invention exhibits excellent stability, which is independent of the current load over a wide range. Even after repeated tempering and subsequent quenching, no separation of the layer and decrease of the electrochemical acitivity can be observed.

In the following, the invention will be explained with the aid of examples.

EXAMPLE 1.

Titanium sheet sections with the dimensions $100\times20\times2$ mm were provided with a coating of manganese dioxide.

Sample 1—The sheet was immersed without special surface treatment in a 20-% aqueous manganese nitrate solution, and was dried and heated to about 300° C. for decomposing the manganese nitrate. After these steps were repeated five times, the coating contained about 1 mg/cm$^2$ $MnO_2$.

Sample 2—The titanium sheet was sandblasted and coated like Sample 1.

Sample 3—A second $MnO_2$-layer was applied electrolytically to a titanium sheet, which had first been provided with a coating of manganese dioxide as above, at a current density of 2 mA/cm$^2$ and a temperature of 60° C. in an electrolytic bath containing 100 g manganese sulfate and 10 g concentrated sulfuric acid per liter. The coating contained a total of about 2 mg/cm$^2$ $MnO_2$.

Sample 4—The titanium sheet was sandblasted and coated by brushing with an aqueous suspension containing 50% $TiO_{0.56}$ powder with a grain size of less than 100 $\mu$m and 0.3% methyl cellulose. The layer, the thickness of which was about 0.5 mm, was dehydrated at a temperature of 80° C. and sintered in a vacuum with a pressure of $10^{-5}$ mbar by heating to a temperature of 1250° C., whereby an insoluble bond with the sheet was formed. During the sintering, oxygen diffused from the oxide layer into the titanium sheet, so that the average composition of the layer was about $TiO_{0.5}$. The sample was then provided, in the same manner as samples 1 and 2, with a coating of manganese dioxide, which contained, referred to the geometric surface, about 1 mg/cm$^2$ $MnO_2$. The samples were tested at 25° C. as anodes in a cell which contained 10% sulfuric acid as the electrolyte. The electrode spacing was 3 mm and the current density 50 mA/cm$^2$.

| Sample | Cell Voltage (t = 0 h) | Service Life[x] |
|---|---|---|
| 1 | 3.1 V | 50 h |
| 2 | 3.0 | 175 |
| 3 | 2.9 | 400 |
| 4 | 2.5 | >3000 |

[x]Service life is the time at which the cell voltage is less than 5 V.

The initial voltage and the service life of the anodes are improved by mechanical pretreatment of the surface of the titanium carrier (Sample 2) and by coating layers containing several individual layers (Sample 3). The anode 4 prepared in accordance with the invention exhibits a cell voltage of about 15% lower, which did not change during the test time of 3000 hours.

EXAMPLE 2

20 g titanium sponge with a grain size of 0.5 to 2.0 mm were filled into a press die and the powder bed was overlaid with 6 g $TiO_{0.5}$ powder. The layers arranged on top of each other were pressed with a pressure of 30 kN/cm$^2$ to form an anode with the dimensions 20×50×6 mm. The thickness of the oxide layer was about 1 mm. The pressed blank was sintered at a pressure of $10^{-5}$ mbar at a temperature of 1250° C.

To a first carrier slab (Sample 1), a coating of manganese dioxide was applied by thermal decomposition of manganese nitrate, as described in Example 1. A second carrier slab (Sample 2) was provided with a manganese dioxide layer by means of electrodeposition.

The samples were tested as anodes in an electrolyte which contained 100 g sulfuric acid, 50 g copper ions and 10 g nickel ions per liter. The current density was 100 mA/cm$^2$.

| Running Time | Sample 1 | Sample 2 |
|---|---|---|
| O h | 1.8 V | 1.7 V |
| 500 | 2.2 | 2.2 |
| 1000 | 2.3 | 2.0 |
| 1500 | 2.1 | 2.1 |
| 2000 | 2.1 | 2.1 |
| 2500 | 2.1 | 2.1 |

The cell voltage is independent of the kind of method used for making the coating of manganese dioxide and, after a slight rise during the initial phase, is practically constant.

EXAMPLE 3

After the addition of 5 parts by weight of a 2% aqueous polyvinyl alcohol solution, 61.4 parts by weight titanium powder (grain size less than 0.06 mm) and 38.6 parts by weight rutile powder (grain size less than 0.01 mm) were mixed in a high-speed mixer for 10 min. and were subsequently pressed in a die press into cylindrical bodies with a diameter of 50 mm at a pressure of 30 kN/cm$^2$. The blanks dried at a temperature of 105° C. were then heated to 1250° C. for 4 hours in an argon atmosphere, and subsequently comminuted in a jaw crusher and milled in a vibratory mill down to a grain size of less than 0.06 mm. The brittle powder with a color like cast iron had a composition of $TiO_{0.56}$.

To 100 parts by weight of powder, 5 parts by weight of a 10% solution of hard paraffin in toluol were added and then mixed in a vortex mixer for 5 minutes and pressed in a die press under a pressure of 25 kN/cm$^2$ into slab-shaped electrode carriers which were heated, after a drying treatment, in a gravity-discharge furnace to 1300° C. in an argon atmosphere. The electric resistivity is about 1.8 ohm mm$^2$/m, the accessible pore volume is about 15%.

The carriers were provided with a coating of manganese dioxide as described in Example 1 and tested under the same conditions as anodes. The mean cell voltage was 2.1 V. The manganese dioxide coating is unique when used in combination with the specific $TiO_x$ carrier in accordance with the invention. Stated another way, the manganese dioxide in accordance with the present invention will give the benefits of very long service life with low voltage under the drastic corrosive conditions of electrowinning whereas lead oxide or titanium oxide or tantalum oxide will not.

There are claimed:

1. Sintered electrode for electrochemical processes especially for electrowinning which comprises a corrosion-resistant carrier consisting at least in part of sintered titanium oxide $TiO_x$, wherein x=0.25 to 1.5, and a coating of manganese dioxide immediately adjacent the carrier and covering at least in part the surface of the carrier.

2. Electrode according to claim 1, wherein x=0.42 to 0.60.

3. Electrode according to claim 1 or claim 2, wherein the carrier consists entirely of titanium oxide $TiO_x$.

4. Electrode according to claim 1 or claim 2, wherein the carrier consists of sintered titanium and a sintered-on layer of titanium oxide $TiO_x$.

5. Electrode according to claim 4, wherein the thickness of the sintered-on layer is 0.1 to 5 mm.

6. Corrosion-resistant electrode for electrolysis for metal contained in aqueous solutions comprising an electrode base consisting at least partially of titanium oxide $TiO_x$, wherein x=0.25 to 1.5, formed by moulding titanium oxide powder and sintering the moulded shape by heating in an inert gas atmosphere to a temperature of from 900° to 1400° C., and a covering layer of manganese dioxide immediately adjacent the molded shape.

* * * * *